United States Patent [19]

Taylor, Jr.

[11] Patent Number: 4,706,363

[45] Date of Patent: Nov. 17, 1987

[54] METHOD OF REINFORCING A STRUCTURAL ASSEMBLY

[75] Inventor: Benson T. Taylor, Jr., Floyd's Knobs, Ind.

[73] Assignee: General Electric Company, Louisville, Ky.

[21] Appl. No.: 905,194

[22] Filed: Sep. 9, 1986

[51] Int. Cl.[4] ..... B23P 11/02

[52] U.S. Cl. ..... 29/453; 29/526 R; 49/388; 49/501; 312/214; 312/257 R

[58] Field of Search ..... 29/453, 432, 526 R; 49/501, 388; 312/257 SM, 214, 257 R; 62/277

[56] References Cited

U.S. PATENT DOCUMENTS

| | | | |
|---|---|---|---|
| 1,400,155 | 12/1921 | Greenburg | 29/453 U X |
| 3,110,093 | 12/1963 | Johnson | 29/453 X |
| 3,979,900 | 9/1976 | Dorflinger et al. | 29/453 X |
| 4,067,628 | 1/1978 | Sherburn | 312/214 |
| 4,070,728 | 1/1978 | Herman | 49/388 X |
| 4,107,833 | 8/1978 | Knight et al. | 312/214 X |
| 4,170,391 | 10/1979 | Bottger | 312/214 |
| 4,557,537 | 12/1985 | Greer | 29/432 X |
| 4,586,348 | 5/1986 | Nakayama et al. | 312/214 X |
| 4,606,112 | 8/1986 | Jenkins et al. | 312/214 X |
| 4,632,470 | 12/1986 | Jenkins et al. | 312/214 |

*Primary Examiner*—Charlie T. Moon

*Attorney, Agent, or Firm*—Frederick P. Weidner; Radford M. Reams

[57] ABSTRACT

A method of reinforcing a structural assembly having an elongated panel with spaced front and rear thin metal walls. One of the panel walls is lanced to form a tang transverse to the elongated panel and attached at one end to the wall and having its opposite end free. One of the panel walls is also lanced to form a resilient tang spaced from the transverse tang and longitudinal to the elongated panel which tang is attached at one end to the wall and its opposite end is free. Both tangs are bent away from their respective walls. A reinforcing member is formed having a length slightly less than the distance between the spaced tangs and a thickness slightly less than the distance between the front and rear walls of the panel. The reinforcing member is properly located in the space between the front and rear walls of the panel by sliding it over the longitudinal tang to abut the transverse tang whereupon the resilient longitudinal tang will spring back and engage the bottom end of the reinforcing member so that the reinforcing member is captured between the tangs. A structural member such as the center hinge pin assembly of a two door refrigerator is secured to the reinforcing member through one wall of the elongated panel.

11 Claims, 6 Drawing Figures

FIG. 1
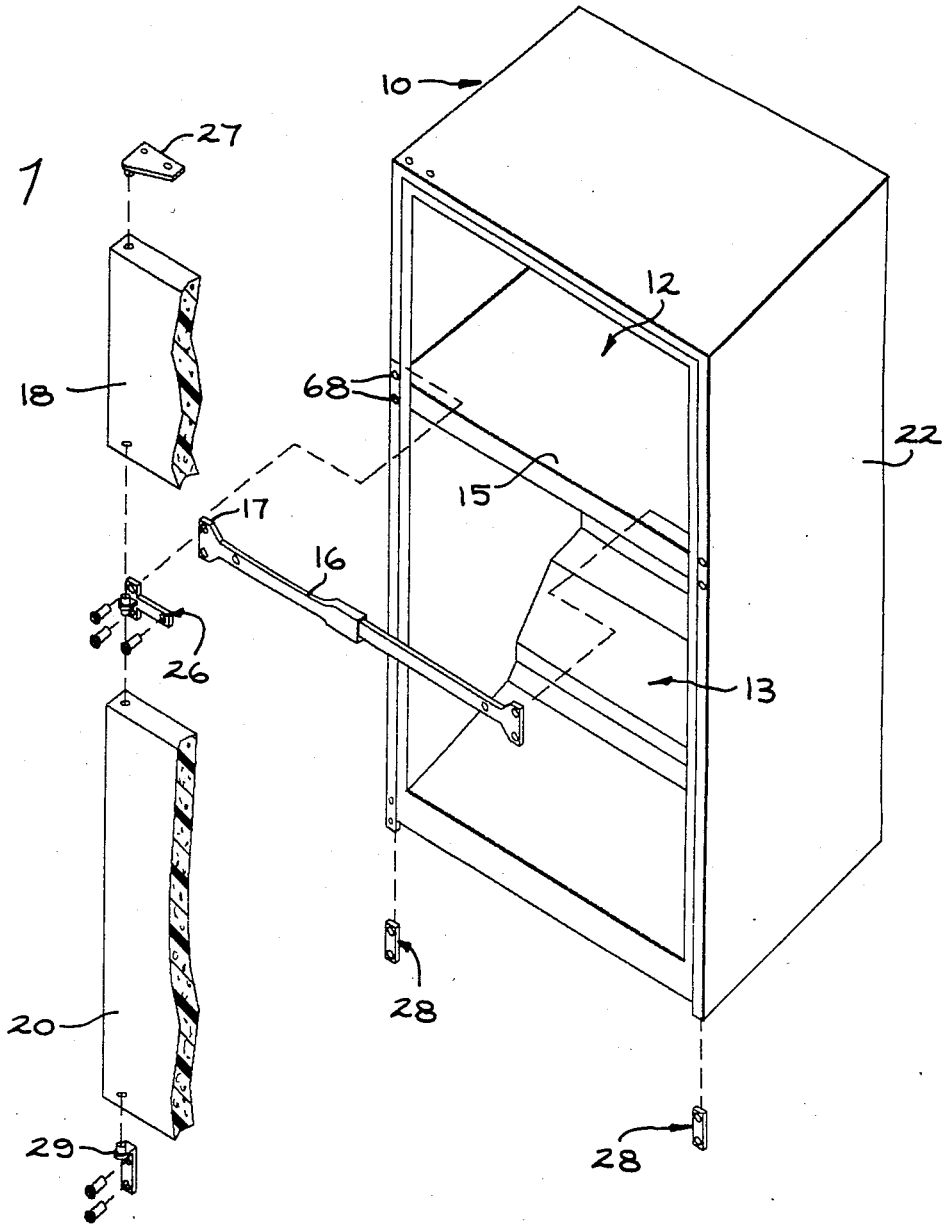
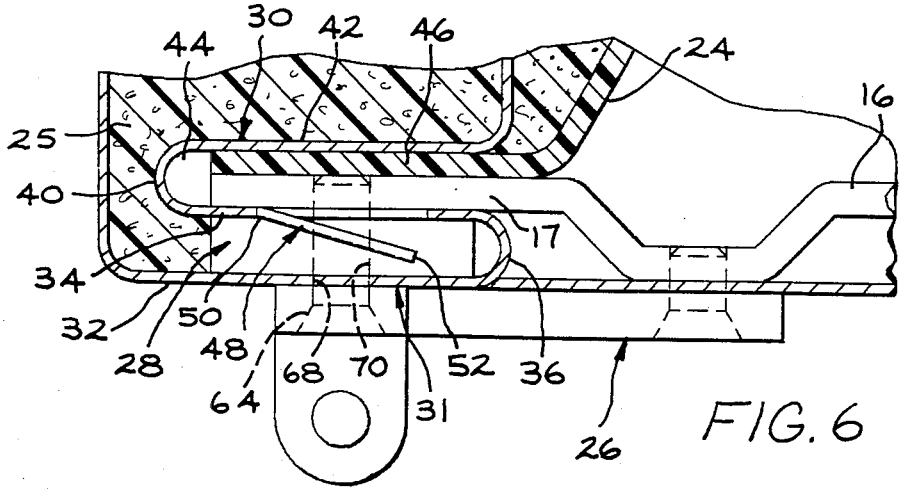
FIG. 6

METHOD OF REINFORCING A STRUCTURAL ASSEMBLY

BACKGROUND OF THE INVENTION

In the construction of a household refrigerator, it is common to separate the refrigerator for separating the refrigerator into first and second compartments such as a freezer compartment and a fresh food compartment, for example. It is further common to have a partition separating the two compartments including a mullion bar across the front of the partition and secured to the cabinet outer case to afford rigidity and strength to the refrigerator. The freezer and fresh food compartments are closed by separate access doors which are hingedly attached to the cabinet outer case. To accomplish hingedly attaching the door to the cabinet, there is a center hinge pin assembly that must be secured to the cabinet in a manner that will provide sufficient strength to carry the doors and provide reliable operation of opening and closing the doors over a long period of time.

By my invention there is provided a method of reinforcing a structure assembly such as in the construction of a household refrigerator having hinged doors wherein the center hinge pin assembly is secured to the cabinet case by utilizing a reinforcing member that together with fastener elements and a mullion bar if desired provides a strong, rigid unitary structure.

SUMMARY OF THE INVENTION

A method of reinforcing a structural assembly including forming an elongated panel having spaced front and rear thin metal walls. One of the panel walls is lanced to form a tang transverse to the elongated panel and is attached at one end to the wall and its opposite end is free. One of the panel walls is lanced to also form a resilient tang spaced from the transversal tang longitudinal to the elongated panel which tang is attached at one end to the wall and its opposite end is free. Both tangs are bent away from their respective walls from which they have been formed. A reinforcing member is formed that has a length slightly less than the distance between the tangs and a thickness slightly less than the distance between the front and rear walls of the panel. The reinforcing member is properly located in the space between the front and rear walls of the panel by sliding it over the longitudinal tang to abut the transverse tang whereupon the resilient longitudinal tang will spring back and engage the bottom end of the reinforcing member so that the reinforcing member is captured between the tangs. A structural member to be secured to the reinforcing member, such as the center hinge pin assembly of a two door refrigerator, is secured to the reinforcing member through one wall of the panel.

By this method of reinforcing a structural assembly a structural member such as the center hinge pin assembly of a two door refrigerator is secured to the outer case and a reinforcing member to provide adequate strength to support the refrigerator doors. In the case of a refrigerator having a mullion bar, it may be secured to the reinforcing member if desired.

BRIEF DESCRIPTION OF THE DRAWINGS

FIG. 1 is an exploded perspective view of a top mount refrigerator showing the fresh food compartment below and the freezer compartment above in which the present invention is useful.

FIG. 6 is a cross-sectional view of the completed assembly.

DESCRIPTION OF THE PREFERRED EMBODIMENT

Figure 2:
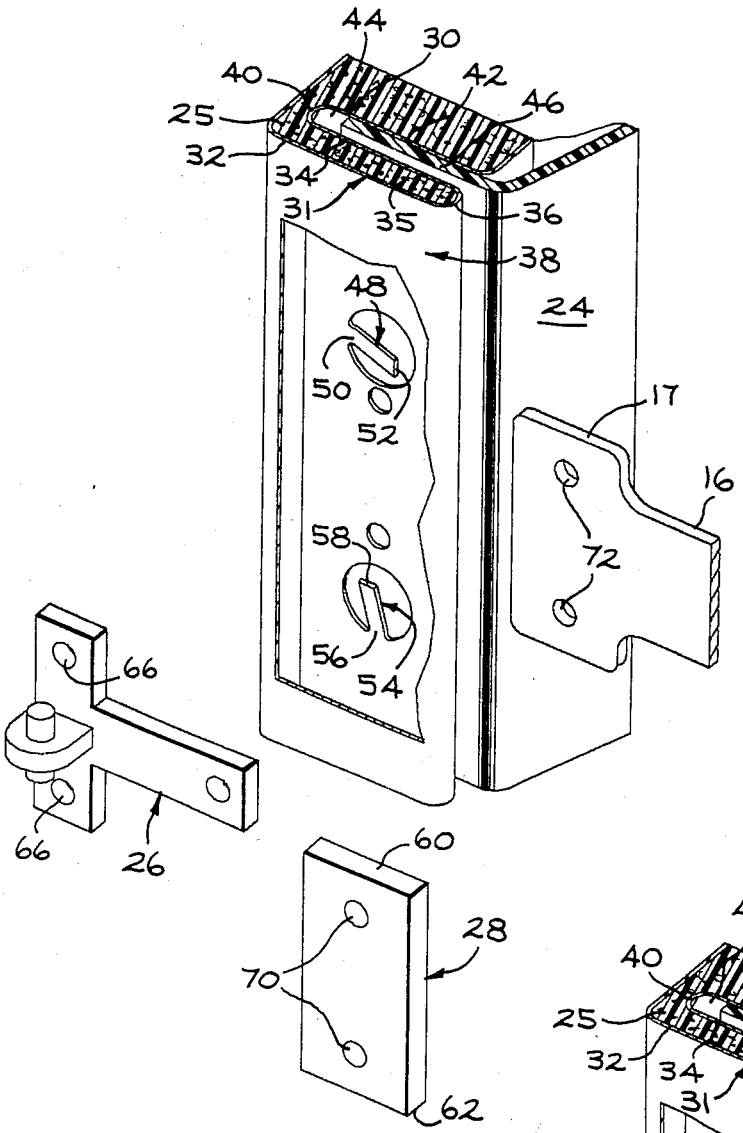
FIG. 2 is a perspective view showing the first step of the present method to assemble a portion of the refrigerator and components.

Referring to FIG. 1, a refrigerator 10 such as a top mount household refrigerator, for example, has a freezer compartment 12, and a fresh food compartment 13 separated by an insulated partition 15 having a mullion bar 16 at the front thereof. The freezer compartment has a door 18 and the fresh food compartment has a door 20 for closing the respective compartments. The refrigerator 10 has a cabinet outer case 22 which envelopes both the freezer and fresh food compartments. The fresh food and freezer compartments have an interior liner 24 which is usually made of plastic material. Between the inner liner 24 and the outer case 22 there is insulation 25 (FIGS. 2–6).

One end of both the freezer door 18 and the fresh food door 20 is hingedly supported by the case 22 by means of a center hinge pin assembly 26. The other end of each door is hingedly supported by hinge pins 27 and 29 at the top and bottom respectively of the refrigerator. To secure the mullion bar 16 to the case 22 and the hinge pin assembly 26 to the case 22 there is a reinforcing member 28 (FIGS. 2–6).

With reference particularly to FIGS. 2–6, the details of the structural assembly to which the method of the present invention is particularly useful will now be discussed. The outer case 22 is made from thin sheet metal and is formed to provide a first U-shaped portion 31 which includes an outer wall 32 and an inner wall 34 spaced from the outer wall to provide a space 35 therebetween, both walls of which are connected by a central reverse bend portion 36 and thus there is provided an elongated panel generally indicated as 38. Continuation of the inner wall 34 and reversely bending it to provide a central portion 40 which then provides wall 42 so that a second U-shaped portion 30 is formed between walls 34 and 42 and these walls are spaced from each other to provide a space or opening 44. The opening 44 is formed to receive a flange 46 of the liner 24 so that it may be joined to the outer case in the area of the elongated panel 38 which is the front face of the refrigerator 10.

In many refrigerators having a freezer compartment and a fresh food compartment which is separated by a partition such as partition 15 there is a structural mullion bar 16 that spans the distance between the sides of the refrigerator and is located in front of the partition 15. This mullion bar is to rigidify and strengthen the refrigerator and therefore it is important that the mullion bar 16 be securely and rigidly fastened to the outer case of the refrigerator. In the case of the preferred embodiment the terminal end 17 of the mullion bar 16 is inserted in the opening 44 along with the flange 46 of the liner 24.

Since the outer case 22 is made of thin metal sheet and even though the elongated panel 38 may be made of two or more walls, it nevertheless is a relatively weak structure for attaching a structural member that is load bearing such as the center hinge pin assembly 26 of a refrigerator. As mentioned previously, this center hinge pin assembly must support portions of the freezer and fresh food doors and perform its function over a long period of time. To strengthen this area of the elongated panel 38 there is provided a nut strip or reinforcing member 28 usually made of plate steel to be used as a back-up for the structure to provide rigidity and strength to the assembly. One of the problems, however, in providing a reinforcing member 28 inside the elongated panel 38 is how to locate it properly within the space 35 between the outer wall 32 and the inner wall 34 of the elongated panel. This is particularly a problem since the outer case is formed in the configuration as shown in FIGS. 2–6 prior to attaching any other components such as the center hinge pin assembly and the reinforcing member 28. The method of this invention includes forming the reinforcing member 28 to have a thickness slightly less than the distance between the front and rear walls of the elongated panel 38 so that it may be inserted into the space 35 and be moved upwardly within the elongated panel to the area that is to be reinforced by the reinforcing member 28. One problem, however, is obtaining the correct positioning of the reinforcing member 28 in the elongated panel 38 to reinforce the assembly and have correct securement and location of the center hinge pin assembly 26 on the elongated panel 38.

The method of this invention calls for lancing one of the panel walls of the elongated panel such as rear wall 34 to form a tang 48 transverse to the elongated panel 38 and attached at one end 50 to the wall from which it is formed and having its opposite end 52 free. The tang is bent away from the wall in which it is formed. Spaced below the transverse tang is another tang formed by lancing one of the panel walls which may be the same wall as the transverse tang wall and this is a longitudinal tang 54. Tang 54 is attached at one end 56 to the wall from which it is formed and its opposite end 58 is free and tang 54 is bent away from the wall in which it is formed. Tang 54 is resilient as it is formed from the thin sheet metal of the outer case 22.

Figure 3:
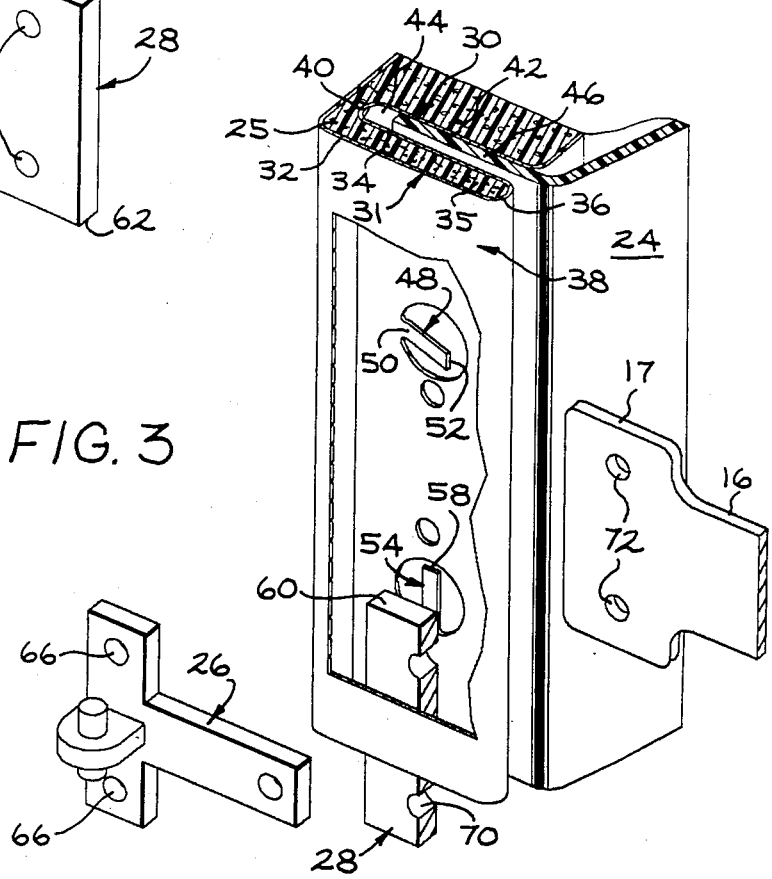
FIG. 3 is the same as FIG. 2 but showing the second step of the method of assembly.
Figure 4:
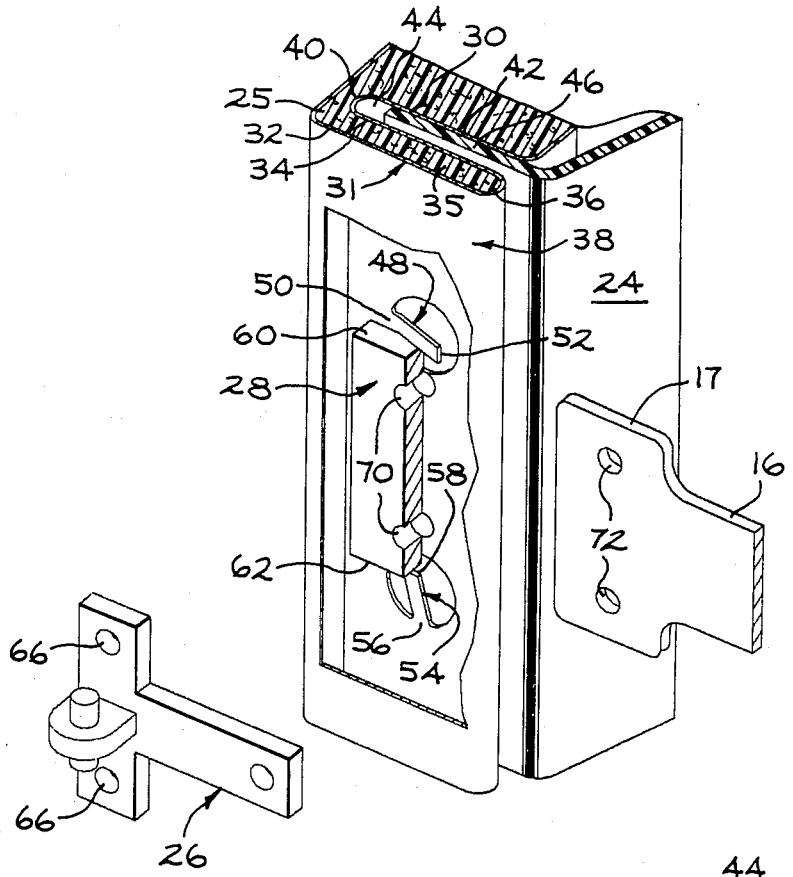
FIG. 4 is the same as FIGS. 2 and 3 but showing the third step of the method of assembly.

With reference to FIG. 3, after the two spaced tangs have been formed as described above, the reinforcing member 28 is inserted into the elongated panel from the bottom and is pushed upwardly through the panel until it reaches longitudinal tang 54. Continued movement of the reinforcing member 28 upwardly depresses the longitudinal tang 54 as shown in FIG. 3 to allow the reinforcing member 28 to pass over the tang 54. Continued movement upwardly of the reinforcing member 28 within the elongated panel moves it to the position shown in FIG. 4 where the end 60 of the reinforcing member 28 abuts the transverse tang 48 and prevents further movement upwardly of the reinforcing member within the elongated panel. Since the length of the reinforcing member 28 is slightly less than the distance between tang 48 and the end 58 of tang 54, once the reinforcing member 28 abuts the transverse tang 48 the longitudinal tang 54 by its resiliency will spring back and engage the bottom end 62 of the reinforcing member 28 and thus the reinforcing member 28 is captured between the tangs 48 and 54. The reinforcing member has now been located in its correct position within the elongated panel as shown in FIG. 4.

Figure 5:
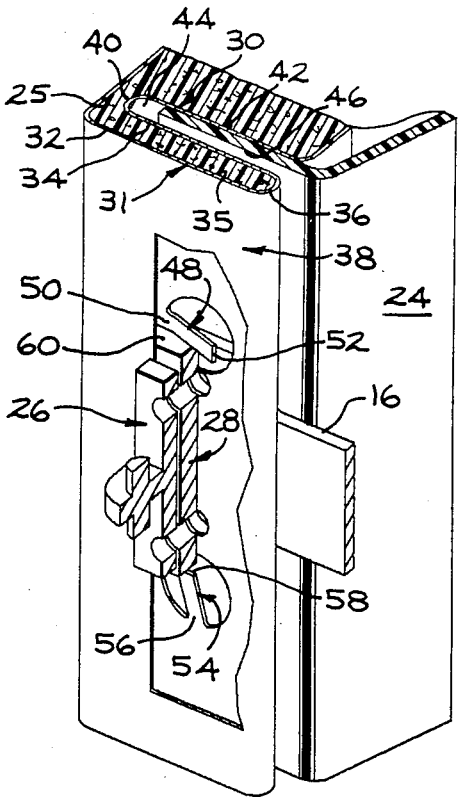
FIG. 5 is the same as FIGS. 2, 3 and 4 but showing the fourth step of the method of assembly.

The next step in the method of reinforcing a structural assembly in accordance with this invention is the placement of a structural member such as center hinge pin assembly 26 on the outer wall 32 of the elongated panel. In the case of refrigerators that also utilize a mullion bar 16 as in the preferred embodiment described herein, the end 17 of the mullion bar 16 is inserted as mentioned previously in the space 44 behind the rear wall 34 of the elongated panel and positioned as shown in FIG. 5. The assembly as shown in FIG. 5 is now ready to receive fasteners 64 (FIG. 6) such as threaded self-tapping screws. The fasteners 64 pass through pre-drilled holes 66 in the center hinge pin assembly 26 and then through pre-drilled holes 68 in outer wall 32 then through pre-drilled holes 70 in the reinforcing member 28 and finally through pre-drilled holes 72 in the mullion bar 16. This completed reinforced structural assembly is now ready for final assembly of the other components of the refrigerator including securing the doors of the freezer compartment and fresh food compartment to the center hinge pin assembly 26.

While, in accordance with the Patent Statute, there has been described what at present is considered to be the preferred method of this invention, it will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A method of reinforcing a structural assembly comprising:

forming an elongated panel having spaced front and rear metal walls interconnected along longitudinal edges thereof, lancing one of the panel walls to form a tang transverse to the elongated panel and attached at one end to the wall and the opposite end free, lancing one of the panel walls to form a resilient tang longitudinal to the elongated panel and spaced from the transverse tang and attached at one end to the wall and the opposite end free, plastically bending both tangs away from their respective walls wall toward the other panel wall, forming a reinforcing member having a length slightly less than the distance between the tangs and a thickness slightly less than the distance between the front and rear walls of the panel, sliding the reinforcing member longitudinally in the space between the front and rear walls of the panel over the longitudinal tang to abut the transverse tang whereupon the longitudinal tang will spring back and capture the reinforcing member between the tangs, providing a structural member to be secured to the reinforcing member, and securing the structural member to the reinforcing member through one wall of the panel.

2. The method of reinforcing a structural assembly according to claim 1 wherein both lances are in the same wall of the elongated panel.

3. The method of reinforcing a structural assembly of claim 1 wherein both lances are in the rear wall of the panel.

4. The method of reinforcing a structural assembly according to claim 1 wherein the elongated panel is formed by reversely bending a thin metal sheet and spacing the front wall from the rear wall.

5. The method of reinforcing a structural assembly according to claim 1 wherein the assembly is in the front face of a refrigerator having a freezer compartment and a fresh food compartment separated by a partition, both compartments having access hinged doors and the structural member is the center hinge for the doors.

6. The method of reinforcing a structural assembly according to claim 5 wherein the reinforcing member is a nut strip and the structural member is secured by screws through the structural member, panel wall and reinforcing member.

7. The method of reinforcing a structural assembly according to claim 5 wherein the assembly includes a mullion bar across the front of the partition between the freezer compartment and fresh food compartment and the mullion bar is secured to the reinforcing member through one wall of the panel.

8. The method of reinforcing a structural assembly according to claim 7 wherein the mullion bar is located behind the back wall of the panel and is secured to the reinforcing member through said back wall.

9. The method of reinforcing a structural assembly in accordance with claim 1 wherein two structural members are provided and one is secured to the reinforcing member through one wall of the panel and the other structural member is secured to the reinforcing member through the other wall of the panel.

10. The method of reinforcing a structural assembly in accordance with claim 9 wherein the assembly is in the front face of a refrigerator having a freezer compartment and a fresh food compartment separated by a partition, both compartments being closed by access hinged doors and one structural member is a mullion bar and the other is the center hinge for the doors.

11. The method of reinforcing a structural assembly according to claim 10 wherein the mullion bar is behind the rear wall of the panel and is secured to the reinforcing member through the rear wall and the center hinge for the doors is in front of the front wall of the panel and is secured to the reinforcing member through the front wall.

* * * * *